US006676270B2

(12) United States Patent
Kostal et al.

(10) Patent No.: US 6,676,270 B2
(45) Date of Patent: Jan. 13, 2004

(54) COMBINED SELF-DEFENSE DEVICE

(76) Inventors: Bretislav Kostal, Zelivecka 12, Praha 10, CZ 106 00 (CZ); Vladimir Kupa, Frant, Sramka 15, Praha 5, CZ 150 00 (CZ)

( * ) Notice: Subject to any disclaimer, the term of this patent is extended or adjusted under 35 U.S.C. 154(b) by 0 days.

(21) Appl. No.: 10/156,778

(22) Filed: May 22, 2002

(65) Prior Publication Data

US 2002/0176254 A1 Nov. 28, 2002

(30) Foreign Application Priority Data

May 23, 2001 (CZ) ..... 2001-1822

(51) Int. Cl.[7] ..... F21V 33/00

(52) U.S. Cl. ..... 362/96; 362/102; 362/200; 362/208

(58) Field of Search ..... 362/96, 102, 200, 362/208

(56) References Cited

U.S. PATENT DOCUMENTS

| | | | | |
|---|---|---|---|---|
| 4,228,484 A | | 10/1980 | Johnstone | |
| 4,968,034 A | | 11/1990 | Hsieh | |
| 5,086,377 A | | 2/1992 | Roberts | |
| 5,158,356 A | * | 10/1992 | Guthrie | 362/188 |
| 5,373,427 A | * | 12/1994 | McLean | 362/96 |
| 5,386,351 A | * | 1/1995 | Tabor | 362/201 |
| 5,405,134 A | * | 4/1995 | Wolfram | 273/84 R |
| 5,549,220 A | * | 8/1996 | Whalen | 222/1 |
| 5,556,003 A | * | 9/1996 | Johnson et al. | 222/39 |
| 5,683,168 A | * | 11/1997 | Teig et al. | 362/96 |
| 5,795,054 A | * | 8/1998 | Booty, Jr. | 362/96 |
| 5,941,629 A | | 8/1999 | Tuscher | |
| 6,052,051 A | * | 4/2000 | Whalen | 340/425.5 |

FOREIGN PATENT DOCUMENTS

| | | |
|---|---|---|
| CZ | 8800 | 4/1999 |
| EP | 0 903 557 | 9/1998 |
| WO | WO 96/19710 | 6/1996 |

* cited by examiner

*Primary Examiner*—Alan Cariaso
*Assistant Examiner*—Jacob Y. Choi
(74) *Attorney, Agent, or Firm*—Collard & Roe, P.C.

(57) ABSTRACT

A combined self-defense device has a spray portion and a light portion the spray portion comprising a spray container with an actuating valve and a spray outlet means. On the front wall of the container there is a flange fixed to carry a nozzle body mounted for longitudinal motion on the upper end of the flange and comprising a conduit for receiving outlet tube, a nozzle directed outside the nozzle body and connected to the conduit and a spray actuating surface on the top thereof. The light portion consists of a light housing to receive a battery and a light source for emitting a light beam substantially in the direction of the nozzle and a switch on the outside of the light housing for connection of the battery to the light source. Preferably the light source is a light emitting diode and as a battery a button battery is used.

8 Claims, 3 Drawing Sheets

COMBINED SELF-DEFENSE DEVICE

FIELD OF THE INVENTION

The invention relates to a manually operated self-defense device comprising in combination a defending spray portion and a light portion. Both means may be used in combination in self-defense actions where the flashlight of the light portion should help the intended victim to allocate the attacker's face and/or to partially blind and deter him and subsequently or at the same time the defending spray can be applied against the attacker's eyes if the attacker continues in his action against the victim.

DESCRIPTION OF THE PRIOR ART

The U.S. Pat. No. 5,405,134 discloses a handle with a spray device attached to a baton, where the baton is in the form of a lamp. A defending spray is located in a transversal part of the handle. Due to its relatively big size and mass this device is designed for a law-enforcement personnel rather than for individuals carrying such device for an occasional and rare use in a handbag or pocket.

The U.S. Pat. No. 5,086,377 discloses a baton i.e. a defending device consisting of a middle portion comprising a defending spray and an end portions with a light and sound alarm devices. This device is also big in size and therefore not suitable to be carried in a handbag or pocket.

From the U.S. Pat. No. 5,086,377 a pistol-shape device is known that includes in a housing a storage battery, two lamps emitting blue and white light respectively, a sound source and a chemical repellent container. The device includes at least three separate compartments, internal wiring and piping to provide the respective connections between the operating switches, battery, lamps and a gas nozzle. The device is operated by two switches and a trigger what may be rather confusing in the situation when it should be used against an unexpected attackers and therefore very quickly and with an immediate and surprising effect. Moreover, due to its considerable size such device is not suitable to be carried in a handbag specifically in a ladies shoulder bag or a clutch bag or a pocket.

The U.S. Pat. No. 5,941,629 discloses a lamp-shape device with a defending gas compartment on one end and a battery and light portion on the other end. The elongated form extends substantially over the palm of the user and in operation the handle must be turned at an angle of 90° or 180° if the gas spray is to be applied after the previous using the lamp. The gas actuator and the electrical switch are situated on the opposite sides of the lamp what may cause certain problems if the device is to be used quickly and with immediate effect against attackers.

SUMMARY OF THE INVENTION

It is therefore an object of the present invention to provide a combined self-defense device that due its simple design and combination of elements used may be of small size and light weight what should enable the user to carry it permanently in the handbag or a pocket like a cellular phone or a digital diary.

Another object of the present invention is to provide a self-defense device that is easy to handle in operation and where the both functions, i.e. the flashlight and the gas spray function may be initiated by one hand and/or one finger.

It is still another object of the invention to provide a self-defense device that may be held in a closed palm secretly and discreetly in an operable position so that a potential attacker may be taken in surprise and immobilized by the intended victim.

Moreover, due to its simple design the self-defense device according to the invention may be easily adapted to the shape of a conventional gas container and to other commercially available parts thus making it susceptible of low costs of manufacture and low sale price.

According to the invention a combined self-defense device has a spray portion and a light portion the spray portion comprising a spray container with an actuating valve and a spray outlet means. On the front wall of the container there is a flange fixed to carry a nozzle body mounted for longitudinal motion on the upper end of the flange and comprising a conduit adapted to receive the spray outlet means a nozzle directed outside the nozzle body and connected to the conduit and a spray actuating surface on the top thereof The light portion consists of a light housing to receive a battery and a light source for emitting a light beam substantially in the direction of the nozzle and a switch on the outside of the housing for connection of the battery to the light source.

Preferably as a light source a light emitting diode is used what permits due to its extremely small size to attach the light portion to any part of the spray portion including the sidewall the bottom of the container or the flange without substantially extending over the conventional shape of the container.

If attached to the actuating surface of the nozzle body the device may be operated by one finger so that both the light and the gas valve may be actuated practically simultaneously or in a step-by-step procedure. In the latter case the light is first actuated by smoothly pressing the switch and then by subsequent additional depressing the switch the spray gas valve is actuated to release the spray from the nozzle.

In the embodiment where the light portion is attached laterally to the flange or incorporated in the flange the switch may be actuated with one finger, for example by the forefinger and the spray gas valve by the thumb, both independently. Moreover where the light portion does not constitute an integral part of the flange the light portion may be removed and used independently as a small pocket lamp.

According to another advantageous embodiment of the invention the lower end of the flange extends at least partially over the sidewall of the spray container. This enables to provide a suitable shape of the whole device for example a uniform cylindrical or prismatic form or to bring the form of the container portion in conformity with the commercial miniature light source.

Other objects and features of the invention will be readily apparent from the following drawings and detailed description of the preferred embodiments.

DETAILED DESCRIPTION

Figure 1:
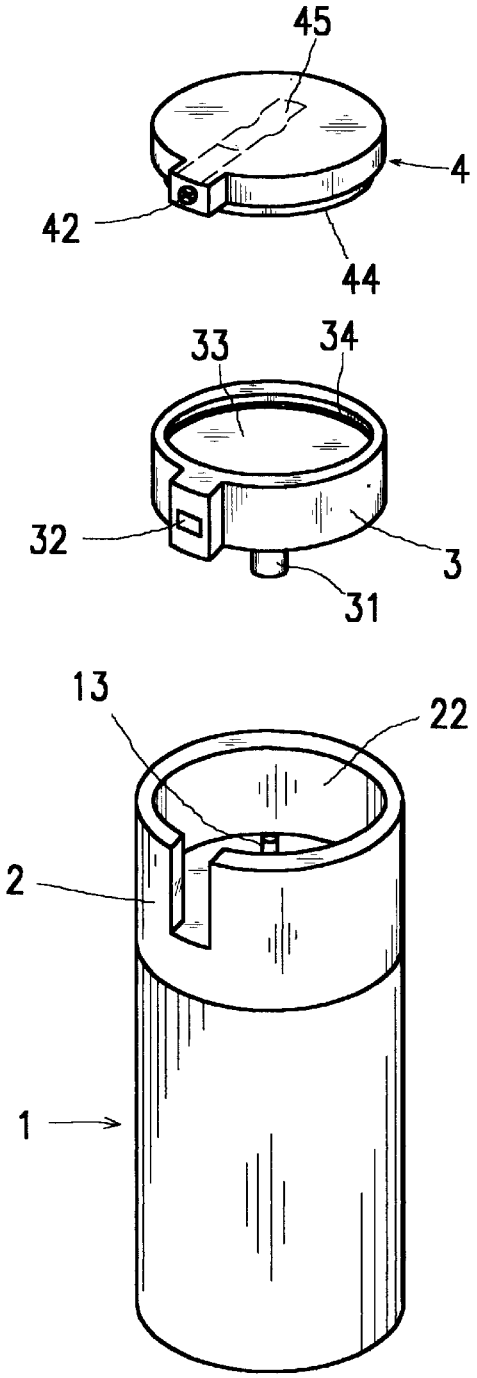
FIG. 1 is a schematic perspective view of a self-defense device with a spray container, a nozzle body a flange and a light portion spaced apart.
Figure 2:
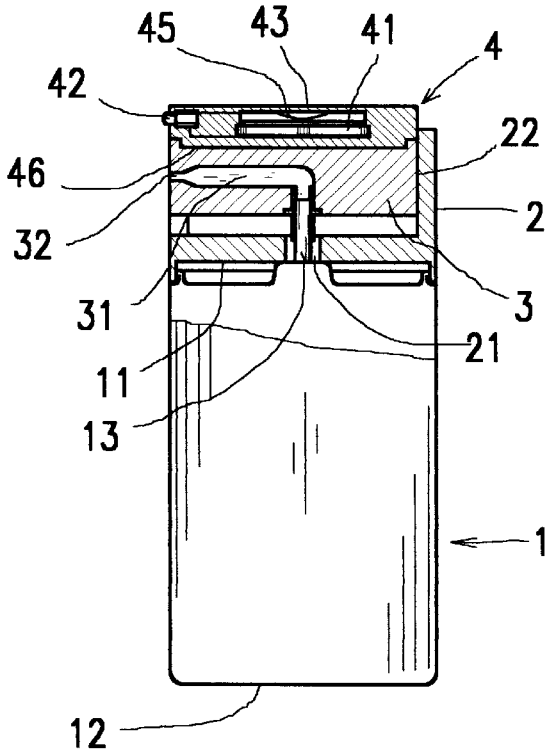
FIG. 2 is a partial sectional view of the assembled self-defense device with a light portion disposed on the upper end of the flange.

The first embodiment of the combined self-defense device according to the present invention is shown in FIG. 1 and FIG. 2. The device consists of a spray portion and a light portion. The spray portion includes a spray container 1 having a bottom 12 a sidewall and a front wall 11. The container 1 is filled in with a repellent irritating gas such as a tear gas or pepper spray etc. The container 1 further comprises a gas outlet tube 13 movable within the front wall 11 and adapted to actuate a valve located inside the container 1 to control the on/off function of the spray container 1. This arrangement represents a conventional part of the most commercially available gas containers and therefore the valve is not shown in the drawings. Further, there is a flange 2 mounted on the front wall 11 provided with an opening 21 for the outlet tube 13 and with an inner sliding surface 22 provided in its upper part in which a nozzle body 3 is mounted for longitudinal motion. The nozzle body 3 has a conduit 31 for receiving the outlet tube 13 of the spray container 1 and connected to a nozzle 32 directed substantially perpendicular to the longitudinal axis of the self-defending device. Thus the top of the nozzle body 3 serves as an actuating surface 33 of the spray container 1. It is to be noted that the outlet tube 13 may be alternatively attached to the conduit 31 of the nozzle body 3 as a part of the conduit to perform the same function of actuating the valve inside the container 1. Both alternatives are further also defined as spray outlet means.

By depressing the actuating surface 33 the whole nozzle moves downwardly so that the conduit 31 engages the outlet tube 13, which brings the valve in the container 1 into the opened position and releases the gas or aerosol held under pressure in the spray container 1. The gas or aerosol is then sprayed out from the nozzle 32.

A light housing 4 is secured to the nozzle body 3 engaging by its lower wall the actuating surface 33 of the nozzle body 3. To provide a secured connection the actuating surface 33 of the nozzle body 3 has a recess 34 that matches with a shoulder 44 performed on the lower wall 46 of the light housing 4. The light housing 4 is preferably in the shape of a disc or a low truncated cone and has an internal cavity in which a battery 41, a switch 43 and the associated contacts and wiring are located. The switch 43 comprises a resilient contact plate 45 disposed on the upper surface of the light housing 4. The light housing 4 is further provided with a lateral hole in the form adapted to hold a light source 42. The light housing 4 is secured in the nozzle body in such a position that the hole axis and consequently the axis of the light source beam are substantially parallel to the axis of the nozzle 32. In the preferred embodiment the battery is a button-type battery and the light source is a light emitting diode which diode, which both are light in weight and occupy a minimum space. This construction enables to attain one of the significant objects of the invention i.e. to provide a small in size, light in weight and comfortable self-defense device.

In operation, when depressing the resilient contact plate 45 by the user's thumb the contact plate 45 bends downwards and actuates the switch 43 to render it in the on-position. The electric circuit is thereby closed and the light source 42—a diode is energized by the battery 41 to emit an intensive beam of light capable to at least temporarily blind an assailant. An additional pressure on the contact plate 45 causes the light housing 4 to move together with the engaged nozzle body 3 downwards in the flange 2 and to actuate the gas valve in the manner described above so that the gas is sprayed out of the nozzle 32. To secure the device against an inadvertent intensive pressing the contact plate 45 and thus releasing the gas to spray out of the nozzle 32 the gas release mechanism of the spray container 1 may be provided by a safety pin or button, which may be also incorporated in the commercially available protective gas containers and therefore is not shown in the drawings. Since the light portion does not constitute an integral part of the nozzle body 3 or the flange 2 the light portion may be removed and used independently as a small pocket lamp.

The following description is directed to other embodiments of the device according to the invention, which however imply many common features and therefore the parts performing the same function are of the same or similar shape and form and bear the same reference numerals.

Figure 3:
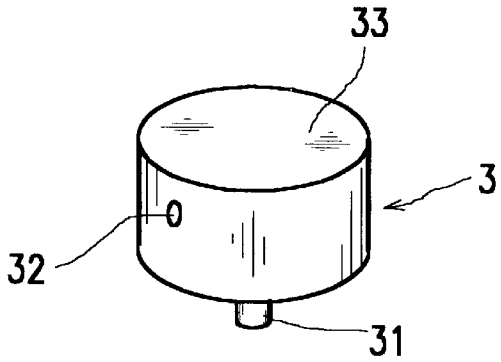
FIG. 3 is a schematic perspective view of a self-defense device with the nozzle body spaced apart and where the light portion is incorporated in the flange.
Figure 3:
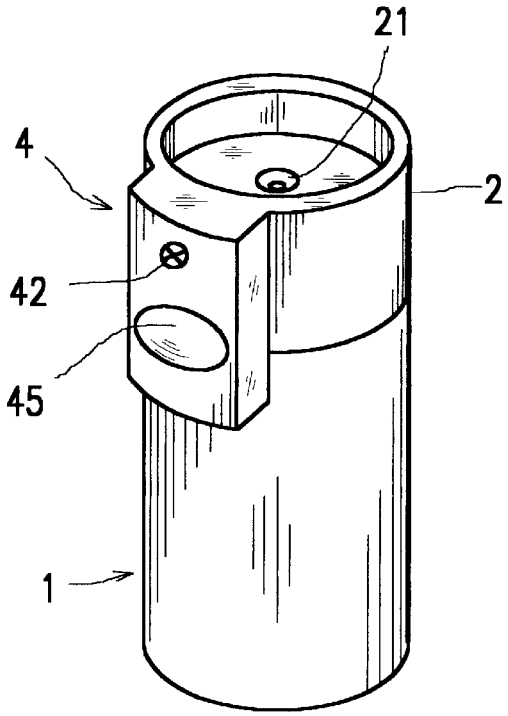
Figure 4:
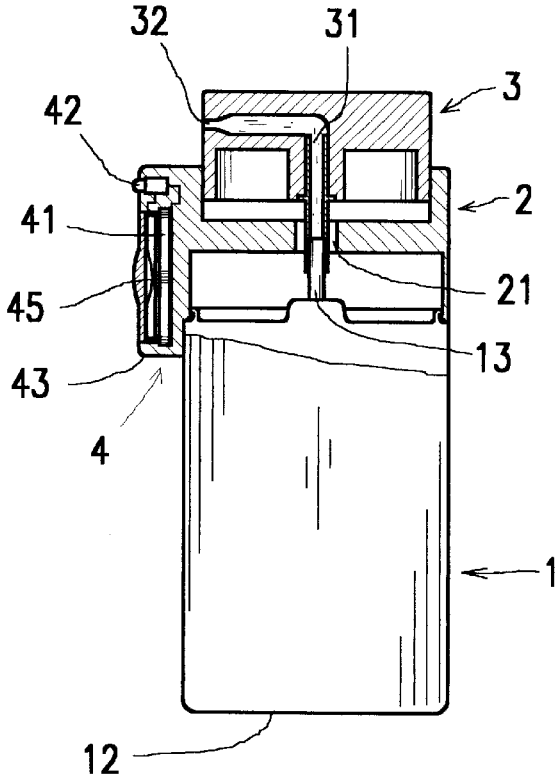
FIG. 4 is a partial sectional view of the device shown in FIG. 3

The second embodiment of the self-defense device according to the invention is shown in FIG. 3 and FIG. 4. With reference to the drawings the container mechanism and that of the nozzle body 3 mounted in the flange 2 and their functions are analogous to the embodiment shown in FIGS. 1 and 2. Therefore, the following description will be limited to the flange 2 and the light source 4. The flange 2 secured to the container 1 as in the previous embodiment is provided by a lateral portion extending out of the cylindrical wall of the flange 2. The lateral portion is similar in shape to the light housing 4 as shown in the first embodiment with the exception that in order to ensure the same direction of the light beam emitted by the light source 42 as that of the nozzle the hole for receiving the light source 42 is made in the upper surface of the light housing 4 along with the switch contact plate 45. Unlike the operation of the device according to the first embodiment of the invention the device of the second embodiment is actuated by two fingers so that the nozzle body 3 is actuated by the thumb and the switch 43 by the index finger. Accordingly, the spray portion may be operated independently of the light portion.

Figure 5:
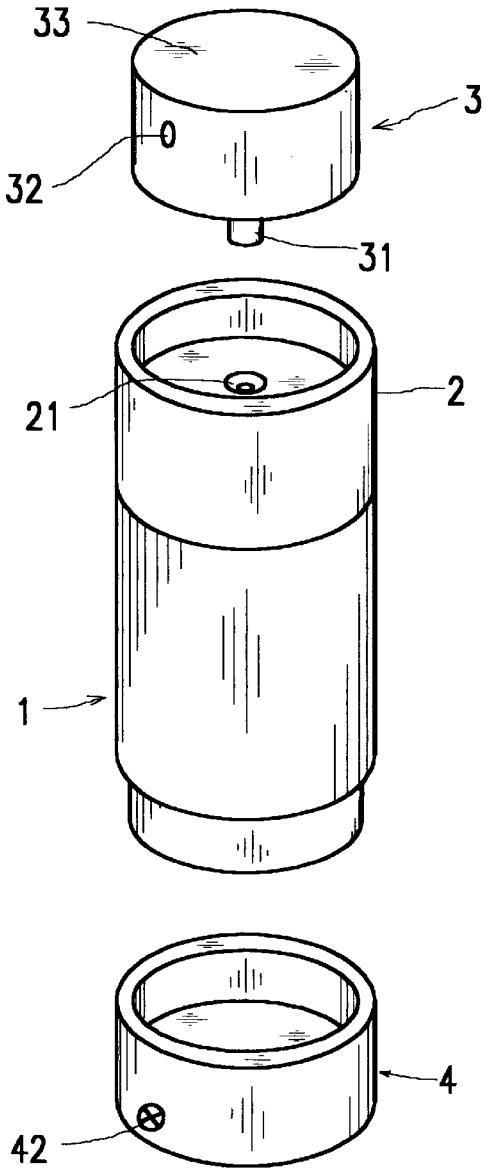
FIG. 5 is a schematic perspective view of a self-defense device before assembly where the light portion is to be attached to the end wall of the spray container.
Figure 6:
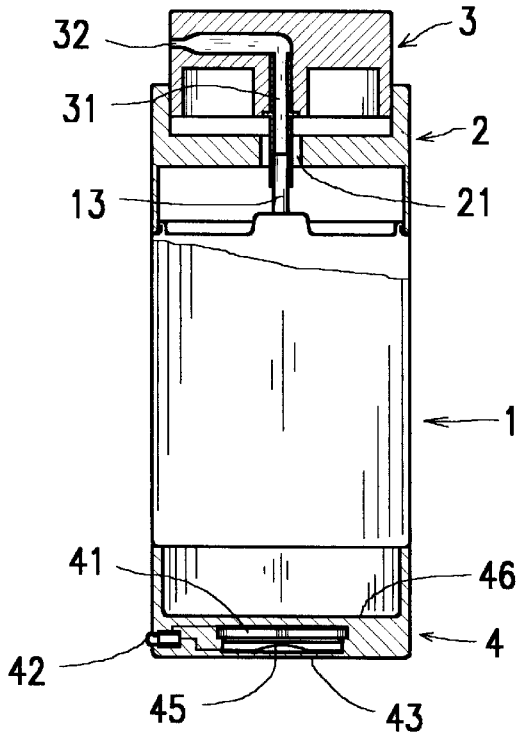
FIG. 6 is a partial sectional view of the device shown in FIG. 5 and assembled.

The third embodiment of the device according to the invention as shown in FIGS. 5 and 6 where the light housing 4 is attached to the bottom 12 of the spray container 1 opposite the flange 2 and the nozzle body 3. As in the previous embodiments the design and function of the spray container mechanism and that of the nozzle body 3 mounted in the flange 2 and their mutual relationship are substantially the same as in the previous embodiments. The light housing 4 may by attached to the spray container 1 by various means including the arrangement shown in FIGS. 5 and 6 where the spray container 1 has a shoulder that matches the corresponding recess in the light housing 4. Like with the first embodiment of the invention the light source 42 is arranged laterally in the light housing 4 so that the light housing 4 may be positioned on the spray container 1 in the manner that the central line of the light beam emitted by the light source 4 is parallel to the axis of the gas nozzle 32. In operation, the device may be used as a lamp or as a gas spray-defending device or in combination in the order described above. Like with the first embodiment the light housing may be removed from the spray container 1 and used as a small pocket lamp.

Figure 7:
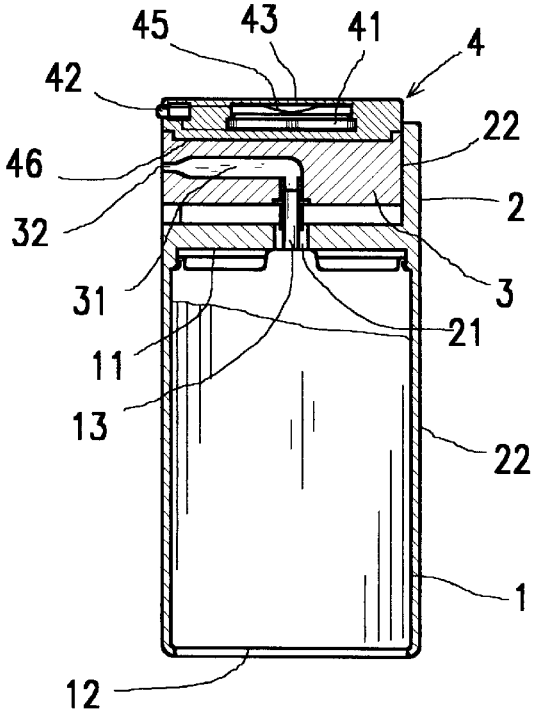
FIG. 7 is a sectional view of a self defense device with the flange provided with a jacket extending over the spray container.

The fourth embodiment of the device according to the invention as shown in FIG. 7 comprises an additional feature that is applicable to all previously described designs of the self-defense device. In this later alternative the flange 2 is provided by an additional element, a jacket 23. The jacket 23 extends downwardly from the lower end of the flange 2 over the whole length of the spray container 1. The jacket 23 thus provides a suitable cover for the spray container 1 and may be formed to any shape different from the shape of a commercially available container or adapted to the shape of a commercially available miniature lamps. This arrangement also allows that the spray outlet means may be actuated by pressing the container 1 on its bottom-side into the jacket 23 towards the flange 2.

The foregoing is considered as illustrative only of the principle of the invention and accordingly all suitable modifications and equivalents that may readily occur to those skilled in the art may be resorted to, falling within the scope of the invention.

What we claim is:

1. A combined self-defense device having a spray portion and light portion, the spray portion comprising:

a spray container with a front wall a side wall a bottom and a spray outlet means for actuating a spray release valve on its upper wall;

a flange with an upper end and a lower end and an opening for the spray outlet means and fixed with its lower end on the upper wall of the spray container;

a nozzle body comprising a conduit for receiving the spray outlet means, a nozzle connected to the conduit and directed outwards the nozzle body, the nozzle body being mounted for longitudinal motion in the flange;

the light portion comprising:

a light housing to receive a battery and a light source disposed adjacent to each other to produce a light beam substantially in the direction of the nozzle;

a switch on the outside of the light housing for connection of the battery to the light source;

means for attaching the light portion to the flange.

2. A combined self-defense device comprising:

a spray container with a front wall, a side wall a bottom and a spray outlet means for actuating a spray release valve;

a flange with an upper end and a lower end and an opening for the spray outlet means and fixed with its lower end on the upper wall of the spray container;

a nozzle body comprising a conduit for receiving the spray outlet means, a nozzle connected to the conduit and directed outwards the nozzle body and an actuating surface on the top of the nozzle body, the nozzle body being mounted for longitudinal motion in the upper end of the flange;

a light housing having an upper surface and a lower surface and adapted to receive a battery and a light source disposed adjacent to each other to emit a light beam substantially in the direction of the nozzle, the lower surface of the light housing engaging the actuating surface of the nozzle body; a switch on the upper surface of the light housing for on/off connection of the battery to the light source.

3. The combined self-defense device of claim 2, wherein the actuating surface of the nozzle body is provided with a recess and the lower wall of the light housing is provided with a shoulder to match with the recess in the nozzle body.

4. The combined self-defense device of claim 2, wherein the battery is a button-type battery and the light source is a light-emitting diode.

5. A combined self-defense device having a spray portion and a light portion;

a) the spray portion comprising:

i) a spray container with a front wall a side wall a bottom and a spray outlet means for actuating a spray release valve;

ii) a flange with an upper end and a lower end and an opening for the spray outlet means and fixed with its lower end on the upper wall of the mounted on the spray container the lower end of the flange extending at least partially over the side wall and/or the bottom of the container; and iii) a nozzle body comprising a conduit for receiving spray outlet means, a nozzle connected to the conduit and directed outwards the nozzle body the nozzle body;

the light portion comprising:

i) a light housing to receive a battery and a light source disposed adjacent to each other to emit a light beam substantially in the direction of the nozzle; and ii) a switch on the outside of the light housing for connection of the battery to the light source; and means for attaching the light portion to the flange.

6. A combined self-defense device comprising:

a) a spray portion comprising:

i) a spray container with a front wall a side wall a bottom and a spray outlet means for actuating a spray release valve on its upper wall;

ii) a flange with an upper end and a lower end and an opening for the spray outlet means and fixed with its lower end on the upper wall of the spray container;

iii) a nozzle body comprising a conduit for receiving the spray outlet means, a nozzle connected to the conduit and directed outwards the nozzle body, the nozzle body being mounted for longitudinal motion in the flange;

b) the light portion comprising:

i) a light housing to receive a battery and a light source disposed adjacent to each other to produce a light beam substantially in the direction of the nozzle and incorporated in the flange;

ii) a switch on the outside of the light housing for connection of the battery to the light source.

7. The combined self-defense device of claim 1, wherein the light source is a light-emitting diode.

8. The combined device of claim 1, wherein the nozzle body is an integral part of the flange.

* * * * *